US007269866B2

(12) United States Patent
Liu

(10) Patent No.: US 7,269,866 B2
(45) Date of Patent: Sep. 18, 2007

(54) AIR BED WITH STABLE SUPPORTING STRUCTURE

(75) Inventor: Feng Liu, Shanghai (CN)

(73) Assignee: Bestway (USA) Inc., Carson, CA (US)

( * ) Notice: Subject to any disclaimer, the term of this patent is extended or adjusted under 35 U.S.C. 154(b) by 0 days.

(21) Appl. No.: 11/317,835

(22) Filed: Dec. 23, 2005

(65) Prior Publication Data

US 2006/0218728 A1 Oct. 5, 2006

(30) Foreign Application Priority Data

Apr. 4, 2005 (CN) ..... 2005 2 0004587

(51) Int. Cl.
*A47C 27/08* (2006.01)
*A47C 27/10* (2006.01)

(52) U.S. Cl. ..... 5/711; 5/710; 5/739

(58) Field of Classification Search ..... 5/706, 5/710–712, 739

See application file for complete search history.

(56) References Cited

U.S. PATENT DOCUMENTS 6,076,214 A * 6/2000 Klimenko ..... 5/710
6,671,910 B2 * 1/2004 Hsu et al. ..... 5/710
6,701,559 B2 * 3/2004 Boso et al. ..... 5/739
6,754,925 B1 * 6/2004 Wang ..... 5/706
6,754,926 B2 * 6/2004 Wang ..... 5/710
6,996,867 B2 * 2/2006 Boso et al. ..... 5/739
7,089,618 B1 * 8/2006 Metzger ..... 5/709

* cited by examiner

*Primary Examiner*—Michael Trettel
(74) *Attorney, Agent, or Firm*—Finnegan, Henderson, Farabow, Garrett & Dunner LLP

(57) ABSTRACT

An air bed with a stable supporting structure comprises a periphery sheet, a top sheet, and a bottom sheet. A middle sheet separates the air bed into an upper air-chamber and a lower air-chamber, an outer extending strip separates the upper air-chamber into a peripheral air-chamber and an upper main air-chamber, a first set of extending strips is provided in the upper main air-chamber, a second set of extending strips, which is welded to the middle sheet and the bottom sheet, is provided in the lower air-chamber, and an oblique extending strip is provided around the periphery of the second set of extending strips and is welded with the periphery sheet and the bottom sheet to separate the lower air-chamber into a lower main air-chamber and a peripheral auxiliary air-chamber. The lower main air-chamber is a space which has a shape of an inverse cone and receives air therein. Its outer surface is concave with respect to the outer surface of the peripheral auxiliary air-chamber, that is, the surface of the peripheral auxiliary air-chamber extends beyond the surface of the bottom sheet of the lower main air-chamber.

4 Claims, 4 Drawing Sheets

AIR BED WITH STABLE SUPPORTING STRUCTURE

BACKGROUND OF THE INVENTION

The present invention relates to an air bed that may be used for family or camping, and more specifically, to an air bed with a stable supporting structure.

An air bed, which can be carried and easily stored, and which can be very comfortable and enjoyed by a user, is becoming more and more popular. This kind of air bed not only may be used as a spare bed for a visitor or a friend, but it also may be used for camping. However, a conventional air bed has a lightweight and a height higher than an air mattress; therefore, it is not sufficiently stable. Hence, when a user lies or sits on an edge of the air bed, one side of the air bed is liable to rise or even turn over, and the user may fall off. In order to solve the problem, some improvements need to be made to the air bed.

As shown in FIG. 4 and FIG. 5, a conventional air bed may comprise a periphery sheet 1, a top sheet 2, a bottom sheet 3, a middle sheet 4, a parallel extending strip set 5 of upper air-chamber, and a parallel extending strip set 6 of lower air-chamber. In this kind of air bed, a supporting air-chamber 7 is provided on the border between the upper air-chamber and the lower air-chamber, and one or more air stabilizing bars 8 are provided around its periphery at the bottom of the air bed; hence, the surface area is increased, the weight is dispersed, and the possibility of turning over is decreased.

As shown in FIG. 6 and FIG. 7, another conventional air bed also comprises a periphery sheet 1, a top sheet 2, a bottom sheet 3, a middle sheet 4, a parallel extending strip set 5 of upper air-chamber, and a parallel extending strip set 6 of lower air-chamber. In this kind of air bed, the upper air-chamber and the lower air-chamber are separate air-chambers that do not communicate with each other. A stabilizing ring 7, which is a separate air-chamber that does not communicate with the lower air-chamber, is provided at the bottom of the air bed. The periphery of the stabilizing ring 7 is larger than the lower air-chamber; therefore, the stability of the air bed is increased by provision of the stabilizing ring 7.

Although these two kinds of air beds can be kept in a stable state and the possibility of their turning over can be decreased, they have three drawbacks: (i) the air stabilizing bars and the stabilizing ring are provided around the periphery of the air bed at its bottom and have a larger volume, and this may cause a user, especially an elderly person or a child, to tread onto a protrusive air stabilizing bar or stabilizing ring and fall off, resulting in an injury; (ii) the two kinds of air beds mentioned above have a complicated structure, which would decrease production efficiency and increase production costs; and (iii) the air beds do not have a very beautiful appearance.

SUMMARY OF THE INVENTION

The object of the present invention is to overcome the above drawbacks of the prior art and provide an air bed that has satisfactory stability, a simple structure, and a very beautiful appearance. The present invention comprises a periphery sheet, a top sheet, a bottom sheet, and a middle sheet, which separates an air bed into an upper air-chamber and a lower air-chamber, a loop of an outer extending strip provided in the upper air-chamber, which separates the upper air-chamber into a peripheral air-chamber and an upper main air-chamber, and a first set of extending strips which is provided in the upper main air-chamber and consists of a plurality of parallel extending strips; characterized in that the air bed further comprises a second set of extending strips, which is provided in the lower air-chamber and consists of a plurality of parallel extending strips, and is welded to the middle sheet and the bottom sheet, and an oblique extending strip, which is provided around the second set of extending strips, and is welded to the periphery sheet and the bottom sheet to separate the lower air-chamber into a lower main air-chamber and a peripheral auxiliary air-chamber; the lower main air-chamber is a space which has a shape of an inverse cone and receives air therein. Its outer surface is concave with respect to the outer surface of the peripheral auxiliary air-chamber, that is, the surface of the peripheral auxiliary air-chamber extends beyond the surface of the bottom sheet of the lower main air-chamber.

The present invention has the following advantages. The oblique extending strip provided in the lower air-chamber creates a peripheral auxiliary air-chamber from the lower air-chamber while it raises the lower main air-chamber, such that the surface of the peripheral auxiliary air-chamber, which is an outer loop, extends beyond the surface of the bottom sheet of the lower main air-chamber, to contact ground. Hence, the air bed has an excellent stability, that is, when a user lies or sits on the edge of the bed, one side of the bed would not rise, the bed is not liable to turn over when used, and unexpected injury resulting from an unstable structure can be avoided. The air bed also has a simple structure, lower production costs, and a very beautiful appearance.

DETAILED DESCRIPTION OF SPECIFIC EMBODIMENTS

The preferred embodiment of the present invention will be described further in detail with reference to the accompanying drawings.

Figure 1:
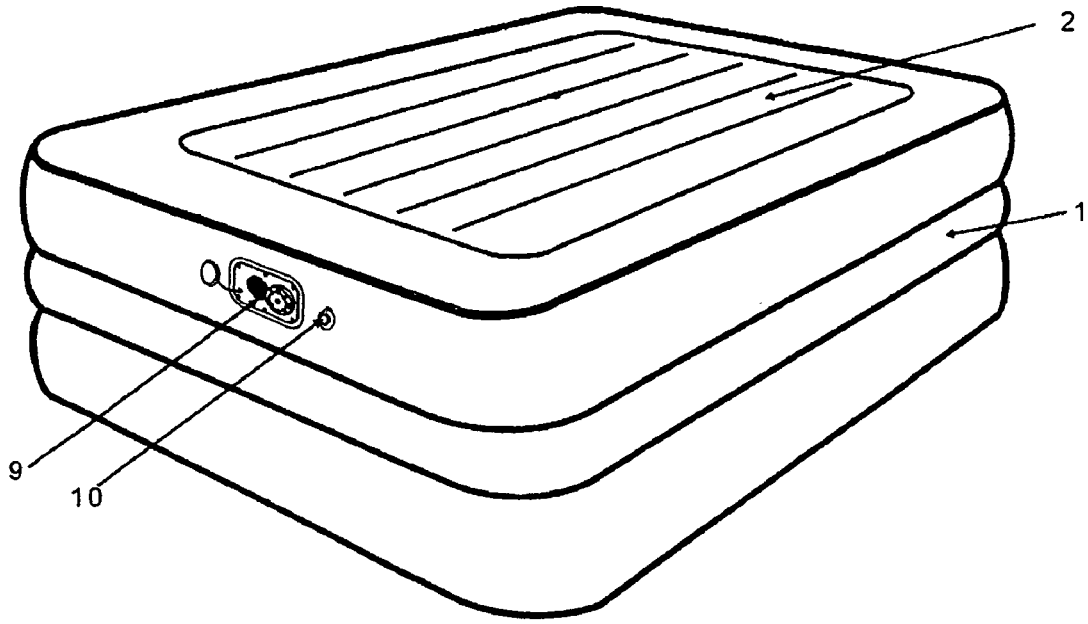
FIG. 1 is a perspective view of the appearance of the present invention.
Figure 2:
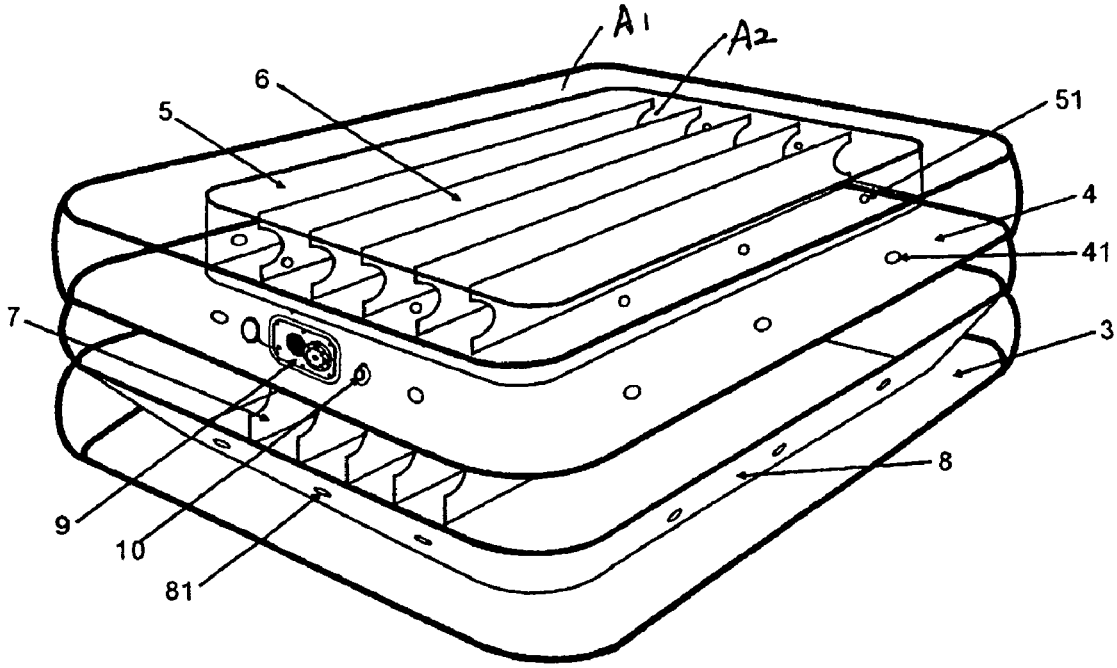
FIG. 2 is a schematic diagram of the internal structure of the present invention.
Figure 3:
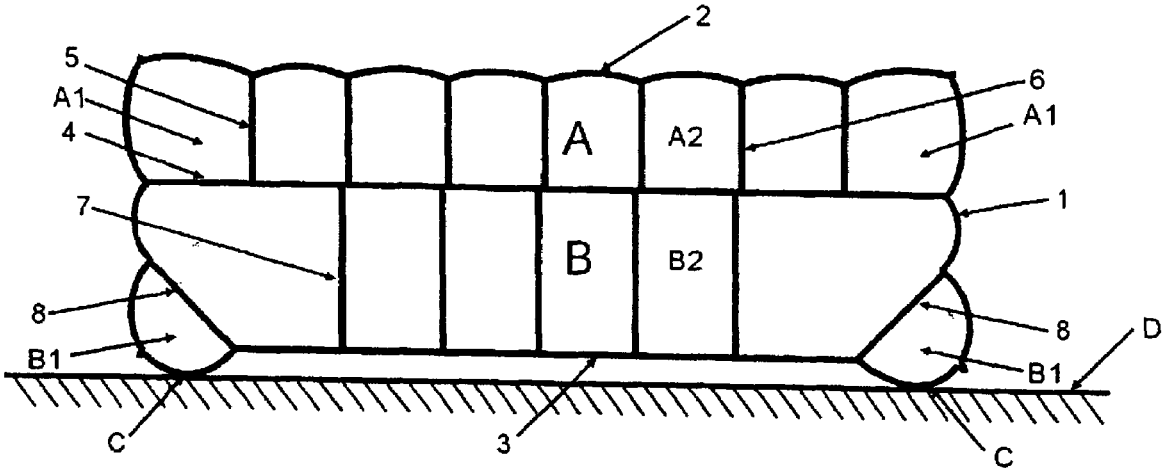
FIG. 3 is a sectional schematic diagram of the present invention.
Figure 4:
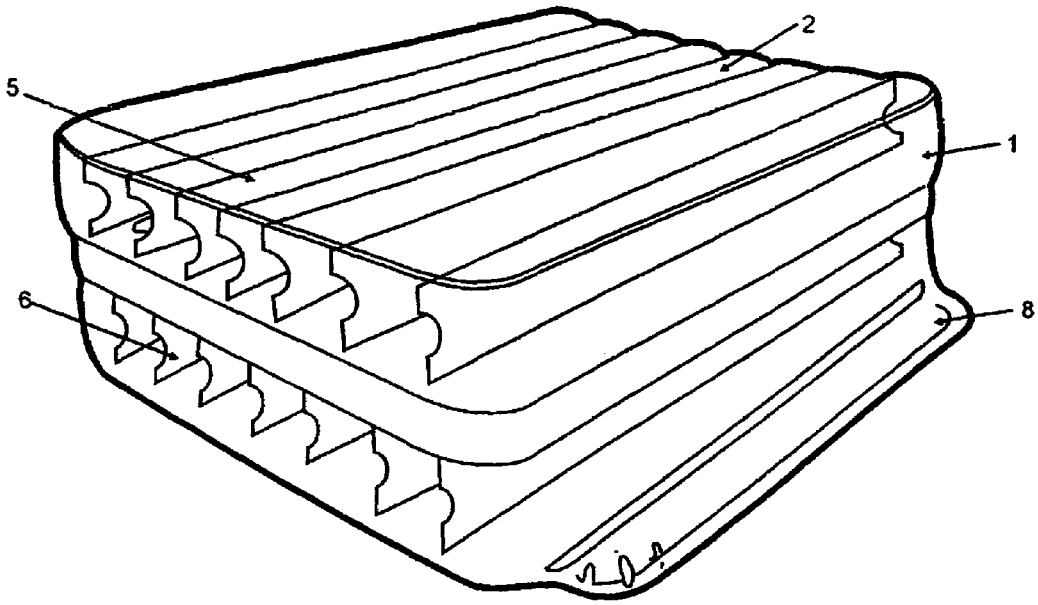
Fig.4 (PRIOR ART)
FIG. 4 is a schematic diagram of the internal structure of an air bed of the prior art.
Figure 5:
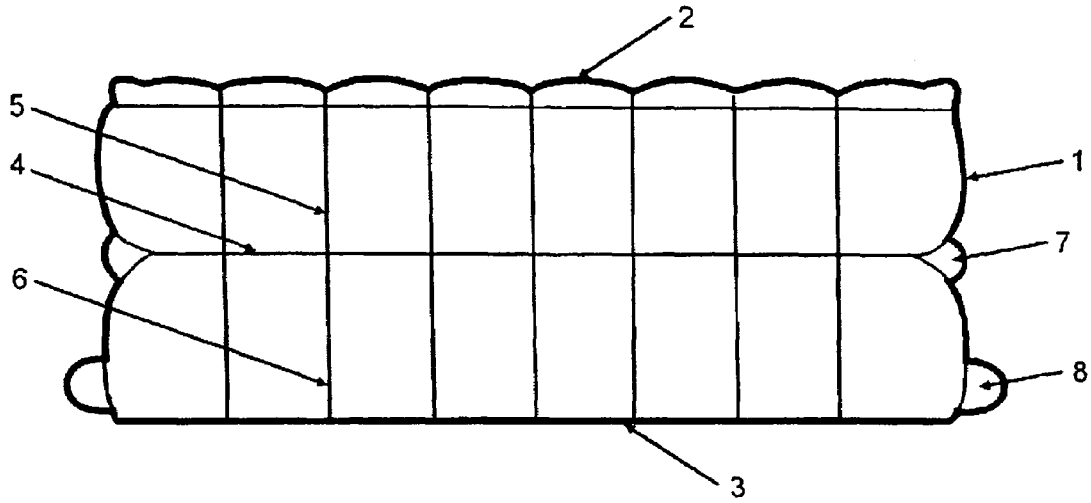
Fig.5 (PRIOR ART)
FIG. 5 is a sectional schematic diagram of FIG. 4.
Figure 6:
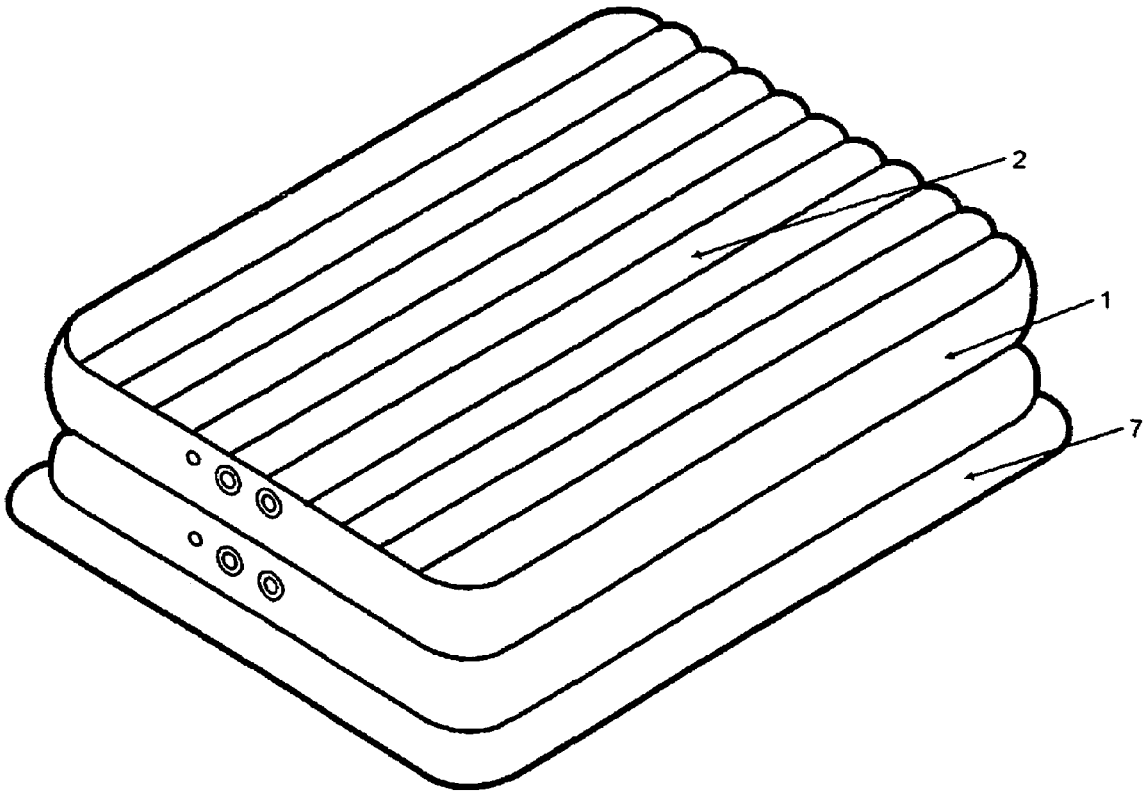
Fig.6 (PRIOR ART)
FIG. 6 is a perspective view of the appearance of another air bed of the prior art.
Figure 7:
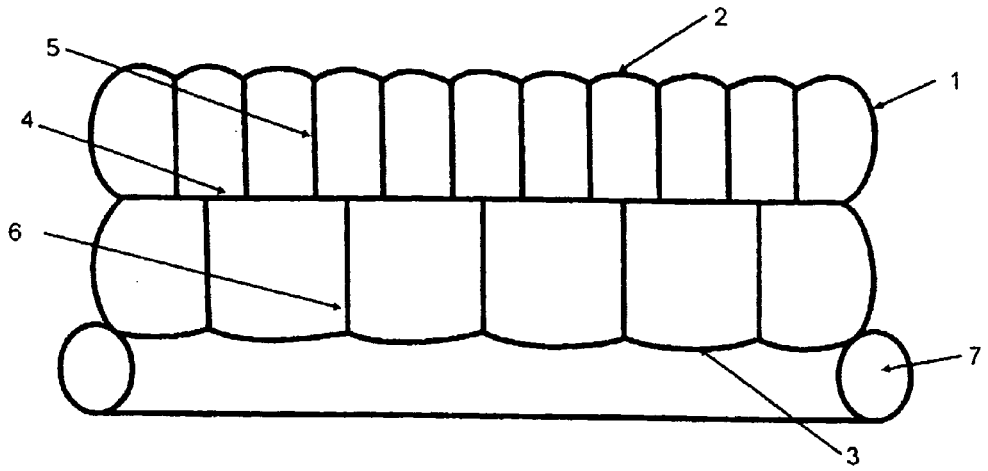
Fig.7 (PRIOR ART)
FIG. 7 is a sectional schematic diagram of FIG. 6.

As shown in FIGS. 1, 2, and 3, the air bed of the invention may comprise a periphery sheet 1, a top sheet 2, a bottom sheet 3, and a middle sheet 4. The upper edge of periphery sheet 1 is welded to the edge of top sheet 2. The lower edge of periphery sheet 1 is welded to the edge of bottom sheet 3, middle sheet 4 is provided between top sheet 2 and bottom sheet 3 and is welded to the middle portion of periphery sheet 1, which separates the air bed into an upper air-chamber A and a lower air-chamber B. Air holes 41 are provided on the middle sheet 4 to communicate upper air-chamber A with lower air-chamber B. A loop of an outer extending strip 5 is provided in the upper air-chamber A to separate upper air-chamber A into a peripheral air-chamber A1 and an upper main air-chamber A2. A first set of extending strips 6, which extends from one end of the air bed to the other end and are arranged in parallel longitudinally is provided in upper main air-chamber A2. The outer extending strip 5 and the first set of extending strips 6 are fuse welded to top sheet 2 and middle sheet 4. Air holes 51 are provided on outer extending strip 5 to communicate peripheral air-chamber A1 with upper main air-chamber A2. A second set of extending strips 7, which extends from one end of the air bed to the other end and are arranged in parallel longitudinally is provided in lower air-chamber B. The second set of extending strips 7 is welded to the middle sheet 4 and bottom sheet 3. A loop of an oblique extending strip 8 is provided around second set of extending strips 7, and one side edge of oblique extending strip 8 is welded to the periphery sheet 1, and the other side edge is welded to bottom sheet 3. This separates lower air-chamber B into a lower main air-chamber B2 and a loop of a peripheral auxiliary air-chamber B1. Air holes 81 are provided on oblique extending strip 8 to communicate peripheral auxiliary air-chamber B1 with lower main air-chamber B2. The lower main air-chamber B2 is a space which has a shape of an inverse cone and receives air therein. Its outer surface is concave with respect to the outer surface of the loop of the peripheral auxiliary air-chamber B1, that is, surface C of peripheral auxiliary air-chamber B1 is higher than (or extends beyond) the surface of bottom sheet 3 of the lower main air-chamber B2. Under the action of second set of extending strips 7 and oblique extending strip 8, lower main air-chamber B2 is raised, so that surface C of peripheral auxiliary air-chamber B1 supports the air bed when it contacts supporting surface D. Peripheral auxiliary air-chamber B1 is positioned around periphery of the lower main air-chamber B2 to thereby define supporting points C of the air bed around the periphery of the bottom of the air bed at its outer side, and therefore, the stability of the air bed is increased. In this embodiment, the air bed can be filled up with air once for its whole air-chambers from air-valve 10 via air-holes 41, 51, 81 with a built-in electrical air pump or other air pump. The air-chambers may be designed to be closed, so that these separate air-chambers will not communicate with each other, and they can be inflated one by one from a valve provided in each air-chamber with an air pump.

Figure 8:
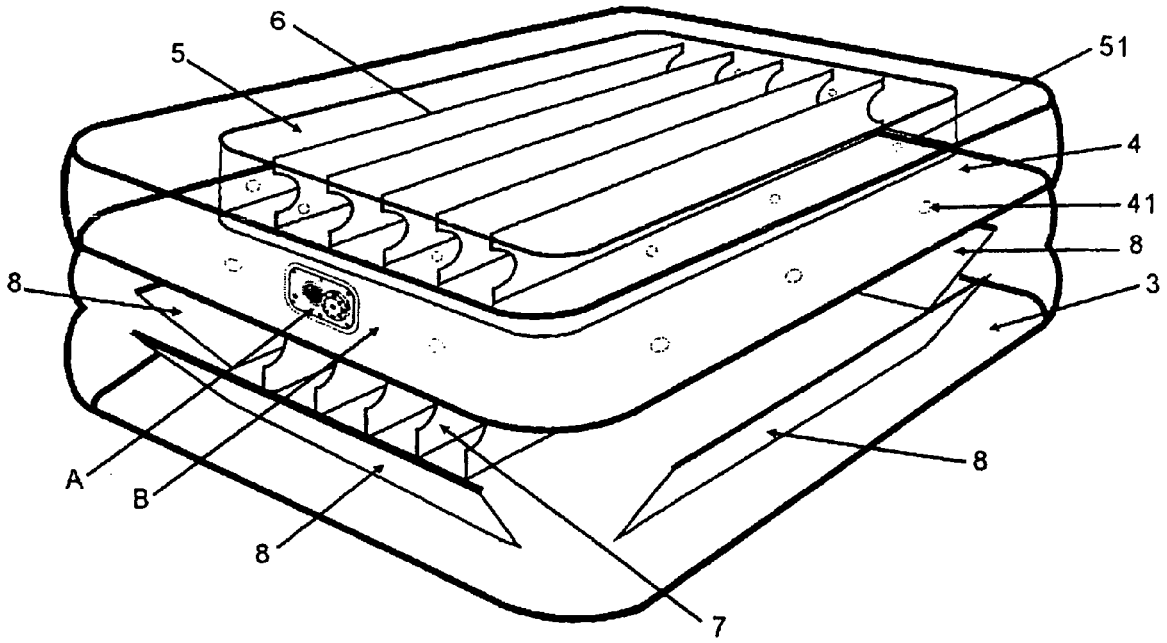
FIG. 8 is a schematic diagram of the internal structure of another embodiment of the present invention.

In another embodiment as shown in FIG. 8, which is similar to the embodiment described above except that a plurality of oblique extending strips 8, for example, four oblique extending strips, two ends of which are not connected with each other, are provided around the periphery of the second set of extending strips 7 in the lower air-chamber B. These four oblique extending strips are welded to periphery sheet 1 around the air bed and bottom sheet 3, respectively.

What is claimed is:

1. An air bed with a stable supporting structure, comprising a periphery sheet, a top sheet, a bottom sheet, a middle sheet, which separates the air bed into an upper air-chamber and a lower air-chamber, a loop of an outer extending strip provided in the upper air-chamber, which separates the upper air-chamber into a peripheral air-chamber and an upper main air-chamber, and a first set of extending strips, which is provided in the upper main air-chamber and consists of a plurality of parallel extending strips; characterized in that the air bed further comprising a second set of extending strips, which is provided in the lower air-chamber, and which includes a plurality of parallel extending strips, and is welded to the middle sheet and the bottom sheet, and an oblique extending strip, which is provided around the second set of extending strips and is welded to the periphery sheet and the bottom sheet to separate the lower air-chamber into a lower main air-chamber and a peripheral auxiliary air-chamber; and the lower main air-chamber includes a space which has a shape of an inverse cone and receives air therein, and an outer surface of the lower main air chamber is concave with respect to an outer surface of the peripheral auxiliary air-chamber, that is, the outer surface of the peripheral auxiliary air-chamber extends beyond the bottom sheet of lower main air-chamber.

2. The air bed with a stable supporting structure according to claim 1, wherein a plurality of air-holes are provided on the loop of the outer extending strip provided in said upper air-chamber.

3. The air bed with a stable supporting structure according to claim 1, wherein a plurality of air-holes are provided on the oblique extending strip provided in said lower air-chamber.

4. The air bed with a stable supporting structure according to claim 1, wherein said oblique extending strip of said lower air-chamber, which becomes a loop, is provided around the periphery of a second set of extending strips, or a plurality of oblique extending strips, which are not connected with each other at two ends of each, are provided around the periphery of the second set of extending strips.

* * * * *